United States Patent [19]

Mayer

[11] Patent Number: 4,859,153

[45] Date of Patent: Aug. 22, 1989

[54] PRESSURE WAVE CHARGER

[75] Inventor: Andreas Mayer, Niederrohrdorf, Switzerland

[73] Assignee: ASEA Brown Boveri Ltd., Baden, Switzerland

[21] Appl. No.: 252,549

[22] Filed: Oct. 3, 1988

[30] Foreign Application Priority Data

Oct. 2, 1987 [CH] Switzerland ..... 3861/87

[51] Int. Cl.[4] ..... F02B 33/42; F04F 11/00

[52] U.S. Cl. ..... 417/64

[58] Field of Search ..... 123/559.2; 417/64; 60/39.45 A

[56] References Cited

U.S. PATENT DOCUMENTS 2,687,843 8/1954 Alcock ..... 417/64
2,836,346 5/1958 Jendrassik ..... 123/559.2 X
3,190,542 6/1965 Vickery ..... 417/64

FOREIGN PATENT DOCUMENTS 1030506 5/1958 Fed. Rep. of Germany ..... 417/64

*Primary Examiner*—Michael Koczo
*Attorney, Agent, or Firm*—Burns, Doane, Swecker & Mathis

[57] ABSTRACT

In a pressure wave charger for the supercharging of internal combustion machines, the cell rotor consists of a ceramic material and is driven by the force of the gases of the internal combustion machine. The cell rotor is located between the air housing and the gas housing. It is bearingly supported on a rotor shaft, which in turn is supported on an axle. Both the axle and the rotor shaft are projecting from the air housing in a manner such that the distance of the cell rotor to the bearing symmetry is minimized. By spring based means a frictional connection is established between the cell rotor and the rotor shaft. The rotor shaft is further protected by a thermal protection device.

7 Claims, 2 Drawing Sheets

PRESSURE WAVE CHARGER

BACKGROUND OF THE INVENTION

1. Field of the Invention

The present invention relates to a pressure wave charger for the charging of internal combustion engines, with a cell rotor, one side of which is closed off by a gas housing and the other by an air housing. The air housing comprises a bearing device for the rotor shaft of the cell rotor.

2. Description of Related Art

For pressure wave chargers used as supercharging assemblies for vehicles with internal combustion engines there exists a general problem in integrating the cell rotor into the other components of the pressure wave charger, particularly with respect to the operation of the bearings. As shown herein, special attention must be paid to the bearing layout.

From EP-0 087 834 B1 a bearing for the cell rotor is known, which is capable of eliminating the disadvantages of the earlier solution wherein the cell rotor was bearingly supported in slide bearings supplied with oil by the lubricating oil system of the engine. This embodiment had the risk that in case of an interruption in the oil supply, for example by the rupture of an oil line, the rotor could be destroyed very rapidly as the result of its high speed of rotation. The bearing of the cell rotor provided by the aforecited reference includes measures assuring a metered, continuous supply of lubricants by means of the introduction of grease from a grease reservoir into the bearings.

In the reference, the rotor shaft is located in the air housing of the pressure wave charger, with the cell rotor fastened by means of its hub to the inner end of the rotor shaft. In this axial fastening mode, the stop face of the cell rotor is mostly located outside the bearing symmetry of the rotor shaft.

If the aforedescribed bearing support of the proportional drive of the pressure wave charger is replaced by a free running pressure wave charger driven by the forces of the gases of the internal combustion engine, such as known for example from European patent application No. 87 101 608.5 of the present applicant, the bearing layout created in this manner would not be optimally correct because of the slight difference between the high operating speed and the critical speed of the bearing layout.

In addition, the installation of cell rotors consisting of a ceramic material, such as those described in EP 0 051 327 B1, could not be recommended, in view of the continuing absence of bearing devices suitable for ceramics.

Based on a bearing device according to the above state of the art, a free running pressure wave charger and a ceramic cell rotor, would lead to a series of inadequacies:

The closeness of the operating speed to the critical bending speed in the case of the first-mentioned bearing layout often leads to vibrations because of the difference between the gravity centers of the mass of the cell rotor and the bearing symmetry.

The static undeterminancy of the rotor shaft support results in stresses in the bearings integrated into the air housing, with negative effects on the running properties of the cell rotor coupled with the rotor shaft.

The rotor shaft rotatably supported in the air housing limits the flow cross section excessively because of the prevailing hub ratio, i.e., its inlet and outlet channel on the air housing side.

The product of the average bearing diameter and its speed is limited in the case of grease lubrication; for this reason the average diameter must be kept small at a given speed.

The mounting of a free running cell rotor on the rotor shaft by means of a necessarily small shoulder as the parallel stop, easily leads to a tilting of cell rotors relative to the axis of the rotor shaft. The result is a wobbling of the rotor while running. Any mounting of the cell rotor on the rotor shaft would lead, in the case of the installation of a ceramic cell rotor, to interference with its seating as the result of the operationally dependent different thermal expansions between the ceramic cell rotor and the metal rotor shaft, even if the hub of the cell rotor is made of an aluminum alloy.

The transfer of heat from the cell rotor to the bearings and the rotor shaft may be impeded by expensive measures only.

OBJECTS AND SUMMARY OF THE INVENTION

An object of the present invention consists of providing, in a pressure wave charger of the aforementioned type, for a ceramic cell rotor contained therein and being driven by the gas forces of the internal combustion engine, a bearing layout that is appropriate for the ceramic and the free running characteristic.

An essential advantage of the invention is to be found in that the bearing elements are located in the rotor hub tube, so that the gravity center of the rotor and the bearing symmetry are close to each other. The ceramic cell rotor is centered with radial clearance on a rotor shaft, which in turn is located on an axle anchored in the air housing. The rotor shaft comprises at its largest diameter a shoulder, which forms the axial stop for the axial frictional connection with the ceramic cell rotor.

The radial clearance should preferably be dimensioned so that in the case of the radial thermal expansion differences between the ceramic cell rotor and the rotor shaft no dangerous tensile stresses are generated in the ceramic and that any imbalance created by differential thermal expansions is kept negligibly small. The invention is particularly advantageous in this respect, because here the diameter ratios are kept especially small.

Centering in the axial direction is further restricted to a few millimeters only; it is required only to assure the positioning of the cell rotor on the rotor shaft only and no transfer of forces is to take place. The axial stop also forms the coldest location of the rotor, whereby the flow of heat to the bearing of the shaft may be minimized.

In addition, potential axial run-out tolerances of said stop shoulder have a lesser effect relative to a wobbling movement of the cell rotor, then if the centering would be forming the seat proper of a cell rotor. In order to provide a bearing appropriate for the ceramic between the cell rotor and the shaft, it is further necessary that the transfer of forces does not generate distortion problems or tensile stresses in the cell rotor.

The axial stop of the cell rotor at the shoulder of the rotor shaft should preferably be effected by the force of a spring acting approximately on the entire impact area. The spring force is to be chosen so that an adequately dimensioned transfer of forces takes place by frictional force.

The bearing layout suitable for the ceramic further comprises a heat protection device for the rotor shaft and its bearing support. The relevancy of this measure to the requirement of a design suitable for the ceramic is that the appropriate cell rotor consists of a ceramic material that necessarily has a high thermal conductivity in order to be able to reduce the thermal stresses generated therein. If there would be no thermal protection measure provided for the rotor shaft and its bearing support, the connection would be unavoidably exposed to a high radiative heat flow with negative effects on the running properties of the cell rotor itself.

The aforementioned measures according to the invention make it possible further for the gravity center of the cell rotor to approximately coincide with the bearing symmetry, whereby the stability of revolution appropriate to "free running" is assured and a high critical speed can be obtained. As the diameter of the axle upon which the rotor shaft is supported, is relatively small, more of a useful area is obtained in the flow cross section, which again has an effect appropriate for "free running".

In the following, examples of the embodiment of the invention are explained with reference to the drawings. All of the elements not required for the immediate understanding of the invention are eliminated. Identical elements are indicated in the different figures by identical reference symbols.

DETAILED DESCRIPTION OF THE PREFERRED EMBODIMENTS

Figure 1:
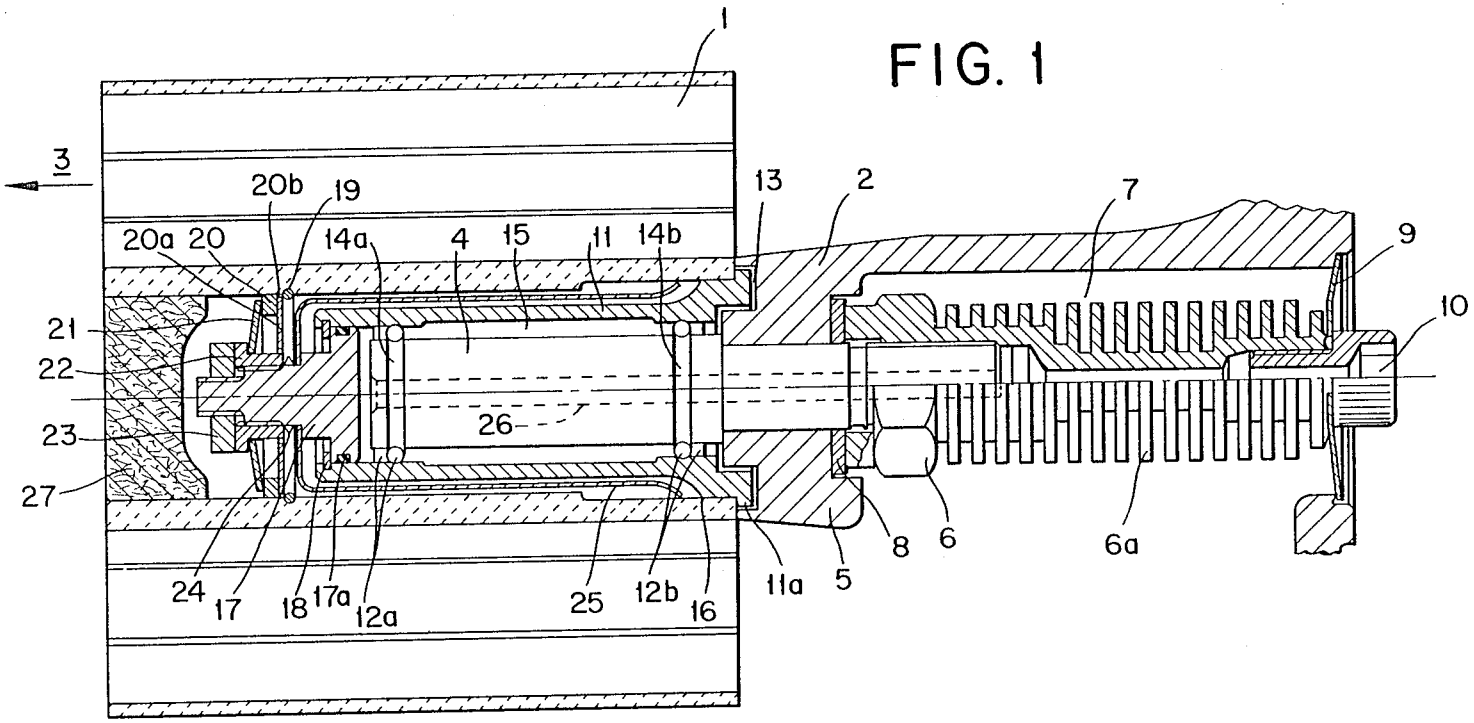
FIG. 1 is a longitudinal cross section of the bearing layout of the present invention.

FIG. 1 shows in part the assembly of the different components of a pressure wave charger. The connection between the cell rotor 1 and the air housing 2 is seen. The gas housing, which would be on the opposite side of the cell rotor, is not shown. The air housing 2 comprises a recess 7, and on the side of the housing facing the cell rotor 1 is a hub 5, in which an axle 4 is frictionally anchored. This frictional connection between the hub 5 and the axle 4 is effected by a nut 6, located in the recess 7 and which secures the axle 4 by means of a washer 8 against the hub 5. The nut 6 itself is additionally designed as a heat exchanger element with a plurality of cooling ribs 6*a*, whereby air can be used as a cooling medium. As a result, the axle 4/nut 6 connection is not loosened by thermal effects.

The axial opening of the recess 7 is closed off by means of a spring washer 9, which is tightened, by means of a screw 10, against the end of the nut 6 on the side of the cooling ribs. As a result, the cooling tip part of the nut 6 is secured in the axial direction frictionally against vibrations, which has a supporting effect on the anchoring of the axle 4. The axle 4 extends in the axial direction into the center of the cell rotor 1.

On the axle 4, a rotor shaft 11 in the form of a one-part bushing is supported, which is positioned in a free standing manner relative to the hub 5. There is an air gap 13 between the hub 5 and the rotor shaft 11.

The bearing support of the rotor shaft 11 and its axial fixation on the axle 4 is effected by a roller bearing consisting of two rows of balls 12*a* and 12*b*. The corresponding ball races 14*a* and 14*b* for the two rows of balls are machined directly into the axle 4 and the rotor shaft 11. Between the rows of balls in the axial direction and between the external diameter of the axle 4 and the internal diameter of the rotor shaft 11 an intermediate space is created, which serves as a grease reservoir. The grease packed into the space gradually releases its oil component, whereby lubrication of the bearing is assured for life. The grease may also be filled into a circumferential recess, not shown, in the axle 4. In order to retain the grease in the above layout in the recess, the latter is covered with a perforated sleeve, again not shown.

The diameter of the axle 4 may be relatively small without negatively affecting its rigidity. This has the advantage that the usable flow cross section of the cell rotor 1 may be maximized. Due to the fact that the axle 4 projects in the axial plane deeply into the cell rotor 1, its center of gravity is near the bearing symmetry. This arrangement makes it possible to operate the cell rotor at a very high critical speed. Also, because of the slight distance of the bearing from the center of gravity, the necessary rigidity of the bearing is assured.

The cell rotor 1 is centered on the rotor shaft 11. This centering surface 16 has a radial clearance of about 0.02 mm relative to the internal bore of the cell rotor 1, so as to avoid tensile stresses in the ceramic part in the case of differential thermal expansions and general imbalances. The centering area is only 3 to 4 mm long and therefore is intended for positioning only. The radial clearance must be limited only to the extent that it does not exceed a permissible imbalance.

The rotor shaft 11 has a shoulder 11*a* on the air housing side, which forms the axial stop surface for the cell rotor 1. By means of the aforedescribed minimization of the size of the bearing, the height of the shoulder may be maximized, i.e., with respect to the diameter of the hub, which yields an optimum reference location for the installation of the cell rotor 1. Care must be taken only to provide a planar parallalism between the shoulder 11*a* and the cell rotor 1. The corresponding head surface area of the cell rotor 1, on the other hand, requires merely machining to assure contact with the shoulder. If planar parallelism of the shoulder 11*a* is present, there is no risk of a tilting position and the resulting wobbling of the cell rotor 1. The cell rotor 1 is pressed against the shoulder 11*a* by axial forces only, thereby forming a frictional joint with said shoulder. Because this stop location also represents the coldest location of the cell rotor 1, thermal effects are reduced to a minimum.

The bearing support of the rotor shaft 11 is closed off on the side of the gas housing by a bolt 17, which is equipped with an 0 ring 17*a* to seal it off against the axle 4. Axial fixation of the bolt 17 relative to the rotor shaft 11 is provided by a retaining ring (Seeger ring) 18. The bolt 17 serves to establish the axial frictional connection of the cell rotor with the rotor shaft 11, i.e., with its shoulder 11*a*. For this purpose, a semicircular groove is provided in the internal diameter of the cell rotor 1, extending in the circumferential direction. A slit wire ring 19 is snapped into the groove. The force required for the establishment of the frictional joint is generated by one or several plate springs 21 pressing against a washer 20 inserted in front of the wire ring 19, said washer preferably consisting of zirconium oxide, in order to minimize the heat flow from the wire ring 19 to the plate spring 21.

The size of the frictional connection between the cell rotor 1 and the shoulder 11*a* may be varied by a bushing 22 threaded onto the bolt, said bushing directly prestressing the plate spring 21. A counter nut 23 secures its position. In front of the washer 20 another washer 20*a* made of copper is inserted, which in the area of its contact location with the wire ring 19, comprises a bevel 20*b*, in a manner such that said bevel produces from the purely axial force direction originating with the plate spring 21 a semiradial component acting on the wire ring 19 and securing the position and the centering function of the wire ring 19. The bevel is seen particularly well in FIG. 2, indicated at 32*a*.

The transferable torque of the cell rotor 1 corresponds to the frictional connection, which in turn is limited by the permissible area unit load of the ceramic material. As, however, large surface areas are taking part in the frictional connection, the torque required for the operation of the pressure wave charger can be provided readily. As indicated above, the stop cell on the side of the air housing between the cell rotor 1 and the shoulder 11*a* forms the coldest point of the rotor. In view of the resultant small absolute expansion difference between the metal and the ceramic, it may be assumed that the radial clearance at the centering surface 16 will change negligibly only and the imbalance is not increased.

Concerning a potentially occurring axial difference in expansion, it may be stated that such a difference will have no effect, as the reserve potential of the plate spring 21 would be able to absorb any differential expansion. The situation is, however, different relative to thermal effects in the region of the bearing, in particular in the area toward the gas housing 3. It must be expected there that the heat from the cell rotor 1 could affect the bearing and severely damage it. As a measure to counter this risk, a hat-shaped heat protector 25 is placed over the rotor shaft 11 to the centering surface. The protector 25 consists preferably of a copper alloy and serves to assure the intensive removal of heat to the coldest location. An example is given below in the description of FIG. 2. The heat protector 25 is locked in place by the threaded bushing 22 establishing a frictional connection by means of plate springs 24. The latter acts, under pressure from the bushing 22, against the closure on the head side of the heat protector 25.

The axle 4 comprises a further measure to remove heat: a copper bolt 26 is inserted in its core, extending into the air housing 2. On the side of the gas housing, the bore of the hub of the cell rotor 1 is closed off by a plug 27, which preferably consists of kaowool and protects the bearing against the radiation and convection of heat.

Figure 2:
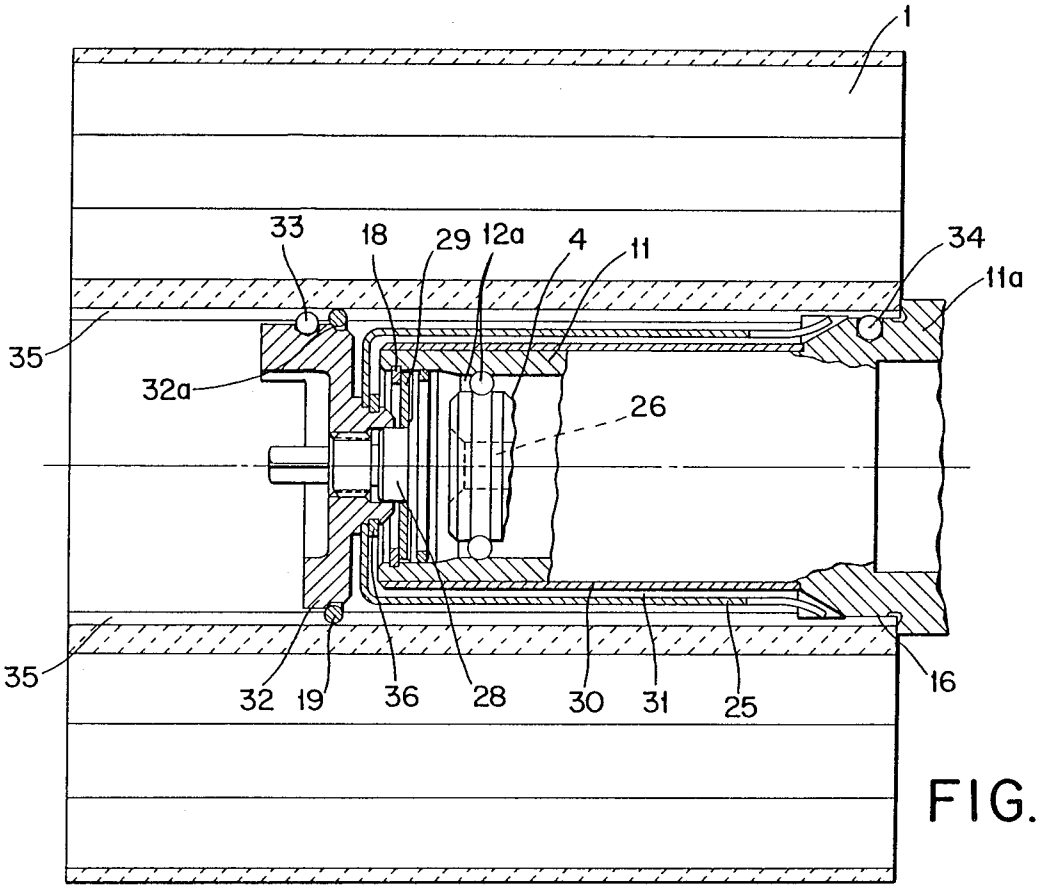
FIG. 2 is a partial longitudinal cross section of an alternative embodiment of a bearing layout in the area of a cell rotor.

FIG. 2 essentially shows an expanded heat protector device 25, 30. The bolt 28 extensively corresponds to that of FIG. 1. The heat protection means for the rotor shaft 11 now comprises a double sleeve, comprised preferably of a thin-walled K profile of copper. A first thermal protection sleeve 30 surrounds the cylindrical part of the rotor shaft 11 up to the centering surface 16. A second hat-shaped thermal protection sleeve 25 extends concentrically and spaced apart from the first sleeve 30, again to the centering surface 16. The hat-shaped thermal protection sleeve 25 is locked in place by a threaded bushing 32, which is threaded onto the bolt 28. The axial closure bottom of said thermal protective sleeve 25 is secured to the threaded bushing 32 by means of a clamping ring 36. The two thermal protection sleeves 25, 30 form a heat conducting longitudinal conduit to the coldest location of the system. The cylindrical annular opening 31 created by the concentric layout of the two thermal protection sleeves 25, 30 may be traversed by a cooling medium, which additionally increases the cooling effect. The axial force effect of the plate spring 29 to establish the frictional connection between the cell rotor 1 and the rotor shaft 11 is applied here in a manner similar to FIG. 1, by tightening the threaded bushing 32 with the bevel 32*a*, which preferably consists of zirconium, against the wire ring 19.

Figure 3:
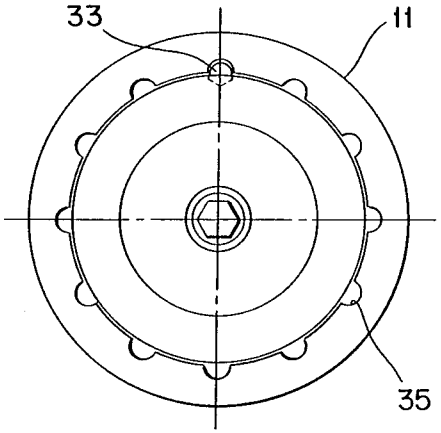
FIG. 3 is a top elevation of the bore of the cell rotor and the closure of the bearing layout of FIG. 2.

The hub of the cell rotor 1 comprises a row of grooves 35 distributed in the circumferential direction, as seen particularly well in FIG. 3, said grooves housing the segment rings, not shown, for the balancing of the rotor, together with the balls 33 and 34 to prevent rotation and to position the threaded bushing and the rotor shaft 11.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. A pressure wave charger for the supercharging of an internal combustion engine, comprising:

a cell rotor which is driven by the force of gases of the internal combustion engine and is comprised of a ceramic material having an air housing closing off one side of the cell rotor and a gas housing closing off the other side of the cell rotor;

an axle anchored in the air housing;

a rotor shaft bearingly supported on the axle and projecting from the air housing, upon which rotor shaft said cell rotor is mounted;

said rotor shaft including a stop shoulder at the side by the air housing and which shoulder is raised relative to a centering surface of the rotor shaft;

means for pressing the cell rotor against the stop shoulder; and a thermal protective device for shielding the rotor shaft.

2. The pressure wave charger according to claim 1, wherein the rotor shaft has a bore that is sealed on the side of the gas housing by means of a bolt, said bolt being positioned by a retaining ring which engages the end of the rotor shaft, with the end of the bolt on the side of the gas housing carrying a threaded bushing and plate springs, and wherein between the plate springs and a wire ring inserted in the hub of the cell rotor, one or several washers are included.

3. The pressure wave charger according to claim 1, wherein the thermal protection device consists of a first thermal protection sleeve surrounding a cylindrical part of the rotor shaft up to the centering surface of the latter, and a second thermal protection sleeve concentric to and spaced apart from said first sleeve, with the second sleeve extending to the centering surface of the rotor shaft, while closing said shaft on the side of the gas housing.

4. The pressure wave charger according to claim 1, wherein the axle is anchored in the air housing by means of a nut, said nut being equipped in the longitudinal direction with cooling ribs.

5. The pressure wave charger according to claim 1, wherein between the axle and the internal diameter of the rotor shaft an intermediate space is located, said space serving as a grease reservoir.

6. The pressure wave charger according to claim 1, wherein the core of the axle includes a copper bolt.

7. The pressure wave charger according to claim 2, wherein the washer adjacent the wire ring has a bevel at its contact pressure location with the wire ring.

* * * * *